US009757841B2

(12) United States Patent
Beckman et al.

(10) Patent No.: US 9,757,841 B2
(45) Date of Patent: Sep. 12, 2017

(54) SYSTEM AND METHOD FOR POLISHING AIRFOILS

(71) Applicant: United Technologies Corporation, Hartford, CT (US)

(72) Inventors: Micah Beckman, Middletown, CT (US); David Masiukiewicz, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 15/048,622

(22) Filed: Feb. 19, 2016

(65) Prior Publication Data

US 2016/0167197 A1 Jun. 16, 2016

Related U.S. Application Data

(63) Continuation of application No. PCT/US2014/060719, filed on Oct. 15, 2014.

(60) Provisional application No. 61/897,157, filed on Oct. 29, 2013.

(51) Int. Cl.

| | |
|---|---|
| ***B24C 1/08*** | (2006.01) |
| ***B24B 31/06*** | (2006.01) |
| ***B24B 19/14*** | (2006.01) |

(52) U.S. Cl.

CPC ..... *B24C 1/083* (2013.01); *B24B 19/14* (2013.01); *B24B 31/06* (2013.01)

(58) Field of Classification Search

CPC ..... B24C 1/083; B24B 19/14; B24B 31/06; B24B 31/062; B24B 31/12

See application file for complete search history.

(56) References Cited

U.S. PATENT DOCUMENTS

| | | | | |
|---|---|---|---|---|
| 5,045,091 | A | 9/1991 | Abrahamson et al. | |
| 6,037,004 | A | 3/2000 | Zajchowski et al. | |
| 6,109,843 | A * | 8/2000 | Descoteaux | B23P 6/002 29/402.02 |
| 6,109,873 | A | 8/2000 | Brooks et al. | |
| 6,402,593 | B1 * | 6/2002 | Shaw | B24C 1/04 451/102 |
| 6,520,838 | B1 | 2/2003 | Shaw | |
| 2002/0098776 | A1 * | 7/2002 | Dopper | B24C 1/06 451/2 |
| 2004/0077293 | A1 * | 4/2004 | Kostar | B24B 1/04 451/36 |
| 2007/0107217 | A1 | 5/2007 | Baus et al. | |

(Continued)

OTHER PUBLICATIONS

International Preliminary Report on Patentability dated May 3, 2016 in Application No. PCT/US2014/060719.

(Continued)

*Primary Examiner* — Dung Van Nguyen

(74) *Attorney, Agent, or Firm* — Snell & Wilmer, L.L.P.

(57) ABSTRACT

An upper shield and a lower shield may be coupled to a rotor for polishing airfoils of the rotor in a vibratory bowl. The upper shield and the lower shield may include spars. The spars may correspond to leading edges and trailing edges of the airfoils. A media including abrasive particles may be flowed through the rotor in the vibratory bowl. The spars may protect the leading edges and trailing edges of the airfoils from excessive material removal by the abrasive particles.

12 Claims, 6 Drawing Sheets

(56) References Cited

U.S. PATENT DOCUMENTS

| | | | | |
|---|---|---|---|---|
| 2011/0047777 | A1 | 3/2011 | Soucy et al. | |
| 2014/0003951 | A1* | 1/2014 | Soucy | B29C 67/0077 416/223 A |
| 2015/0375360 | A1* | 12/2015 | Beckman | B24B 19/14 451/36 |

OTHER PUBLICATIONS

International Search Report and Written Opinion dated Jan. 16, 2015 in Application No. PCT/US2014/060719.

* cited by examiner

SYSTEM AND METHOD FOR POLISHING AIRFOILS

CROSS-REFERENCE TO RELATED APPLICATIONS

This application is a continuation of, claims priority to and the benefit of, PCT/US2014/060719 filed on Oct. 15, 2014 and entitled "SYSTEM AND METHOD FOR POLISHING AIRFOILS," which claims priority from U.S. Provisional Application No. 61/897,157 filed on Oct. 29, 2013 and entitled "SYSTEM AND METHOD FOR POLISHING AIRFOILS." Both of the aforementioned applications are incorporated herein by reference in their entirety.

FIELD OF INVENTION

The present disclosure relates generally to gas turbine engines. More particularly, the present disclosure relates to polishing gas turbine engine components.

BACKGROUND OF THE INVENTION

Gas turbine engines (such as those used in electrical power generation or used in modern aircraft) typically include a compressor, a combustion section, and a turbine. The compressor and the turbine typically include a series of alternating rotors and stators. The rotors may be polished in a vibratory bowl in order to remove non-uniformities on the rotor blades.

SUMMARY OF THE INVENTION

A shield for use in polishing an airfoil may comprise a shield disk and a spar. The spar may extend radially outward from a circumference of the shield disk.

A system may comprise a first shield, a second shield, and a rotor. The first shield may comprise a first spar. The second shield may comprise a second spar. The second shield may be coupled to the first shield. The rotor may comprise a blade. The rotor may be located between the first shield and the second shield.

A method for polishing a component having an airfoil may comprise coupling a first shield to the component. The first shield may comprise a first spar. The method may include coupling a second shield to the component. The second shield may comprise a second spar. The method may include flowing an abrasive media through the component.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1:
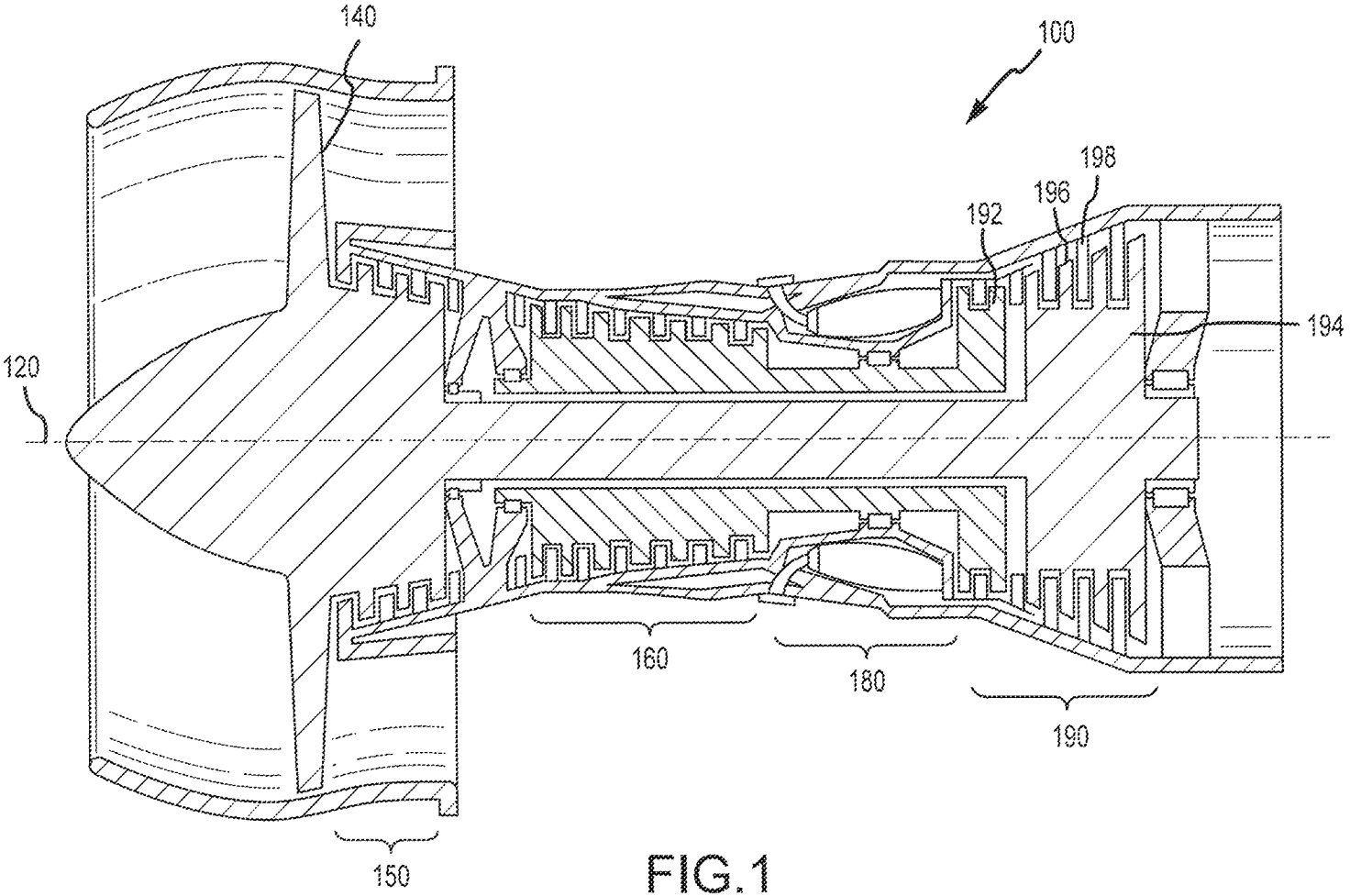
FIG. 1 illustrates a schematic cross-section view of a gas turbine engine in accordance with various embodiments.

Referring to FIG. 1, a gas turbine engine 100 (such as a turbofan gas turbine engine) is illustrated according to various embodiments. Gas turbine engine 100 is disposed about axial centerline axis 120, which may also be referred to as axis of rotation 120. Gas turbine engine 100 may comprise a fan 140, compressor sections 150 and 160, a combustion section 180, and a turbine section 190. Air compressed in the compressor sections 150, 160 may be mixed with fuel and burned in combustion section 180 and expanded across turbine section 190. Turbine section 190 may include high pressure rotors 192 and low pressure rotors 194, which rotate in response to the expansion. Turbine section 190 may comprise alternating rows of rotary airfoils or blades 196 and static airfoils or vanes 198. FIG. 1 provides a general understanding of the sections in a gas turbine engine, and is not intended to limit the disclosure. The present disclosure may extend to all types of turbine engines, including turbofan gas turbine engines and turbojet engines, for all types of applications.

The forward-aft positions of gas turbine engine 100 lie along axis of rotation 120. For example, fan 140 may be referred to as forward of turbine section 190 and turbine section 190 may be referred to as aft of fan 140. Typically, during operation of gas turbine engine 100, air flows from forward to aft, for example, from fan 140 to turbine section 190. As air flows from fan 140 to the more aft components of gas turbine engine 100, axis of rotation 120 may also generally define the direction of the air stream flow.

Figure 2:
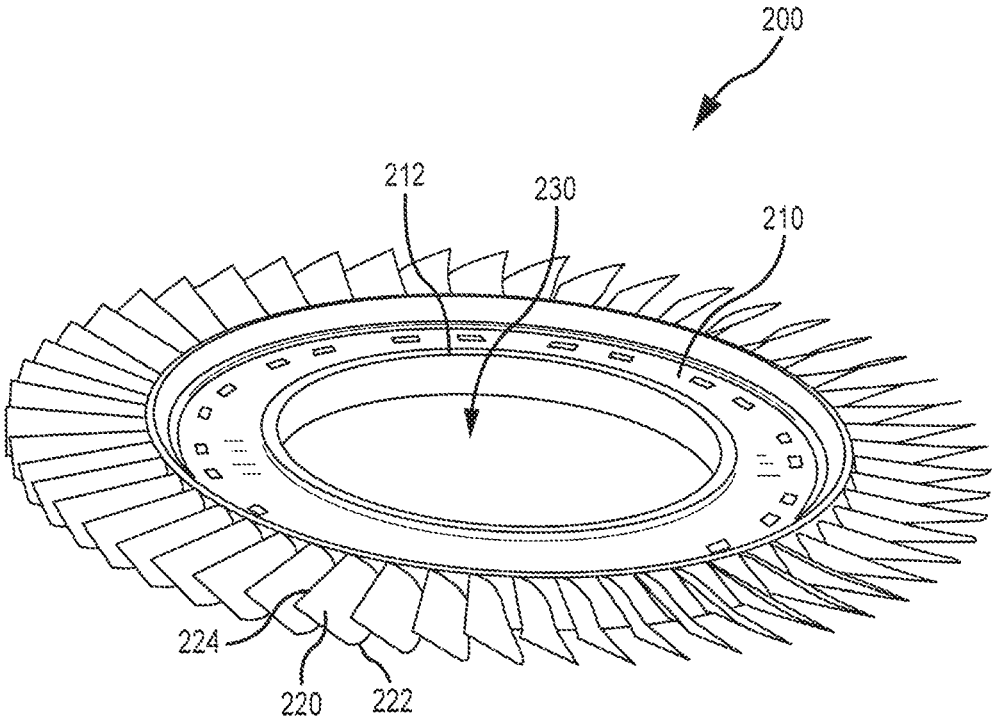
FIG. 2 illustrates a perspective view of a rotor in accordance with various embodiments.

Referring to FIG. 2, a perspective view of a rotor 200 is illustrated according to various embodiments. In various embodiments, rotor 200 may comprise an integrally bladed rotor ("IBR") as illustrated in FIG. 2, wherein rotor 200 comprises a single component comprising rotor disk 210 and blades 220. In various embodiments, an IBR may be formed using a variety of technical methods including integral casting, machining from a solid billet or by welding or bonding blades to a rotor disk. In various embodiments, rotor 200 may be a rotor in compressor sections 150, 160 of gas turbine engine 100 in FIG. 1. In another aspect rotor 200 may be a rotor in the fan 140 section of the gas turbine engine 100 shown in FIG. 1. In other aspects, rotor 200 may be located in the turbine section 190 of the gas turbine engine 100. However, in various embodiments, rotor 200 may comprise any type of rotor for which polishing may be desirable.

Referring to FIG. 2, rotor disk 210 may comprise a bore 230 defined by an inner circumference 212 of rotor disk 210. Blades 220 may comprise leading edge 222 and trailing edge 224. The systems and methods described herein are described primarily with reference to rotors and integrally bladed rotors. However, one skilled in the art will appreciate that the systems and methods described herein may be consistent with many other components comprising airfoils (such as turbine vanes) which may be polished in a vibratory bowl.

Figure 3:
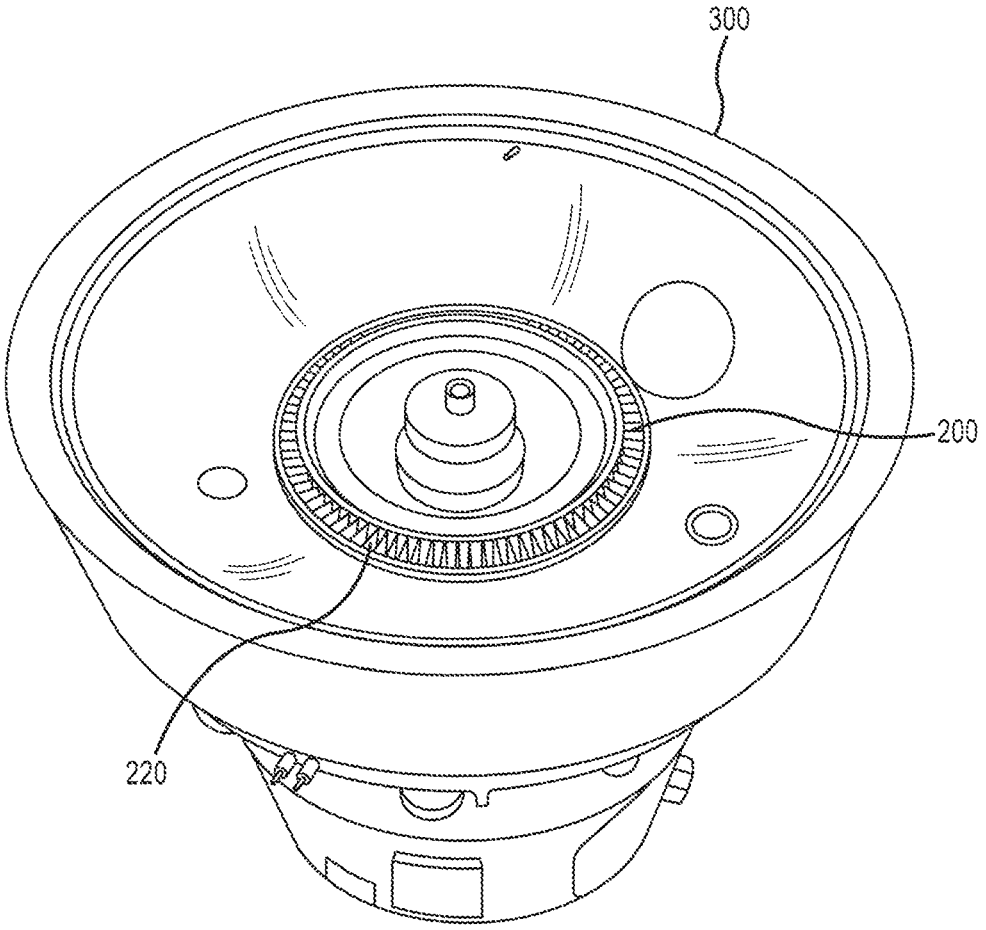
FIG. 3 illustrates a perspective view of a rotor in a vibratory bowl in accordance with various embodiments.

Referring to FIG. 3, a perspective view of rotor 200 mounted in a vibratory mass media finishing bowl ("vibratory bowl") 300 is illustrated according to various embodiments. In various embodiments, rotor 200 may be polished by submersing rotor 200 in a media comprising abrasive particles in vibratory bowl 300. The abrasive particles may comprise a variety of shapes and sizes. In various embodiments, the abrasive particles may comprise at least one of cylinders, cones, and spheres. However, in various embodiments, the abrasive particles may comprise any suitable shape for polishing rotor 200. In various embodiments, the abrasive particles may comprise at least one of ceramic and polyester. However, in various embodiments the abrasive particles may comprise a variety of suitable materials, such as corn cobs, walnut shells, or any other material suitable for polishing rotor 200. Vibratory bowl 300 may flow the media such that the media carries the abrasive particles over blades 220. Additionally, vibratory bowl 300 may vibrate. In various embodiments, the media may flow substantially vertically between blades 220. However, in various embodiments, rotor 200 may be submersed in a horizontally flowing media, such as in a trough tumbler. The abrasive particles may polish blades 220 by contacting blades 220 and removing non-uniformities on surfaces of blades 220. The polishing process may remove some material from blades 220.

Figure 4:
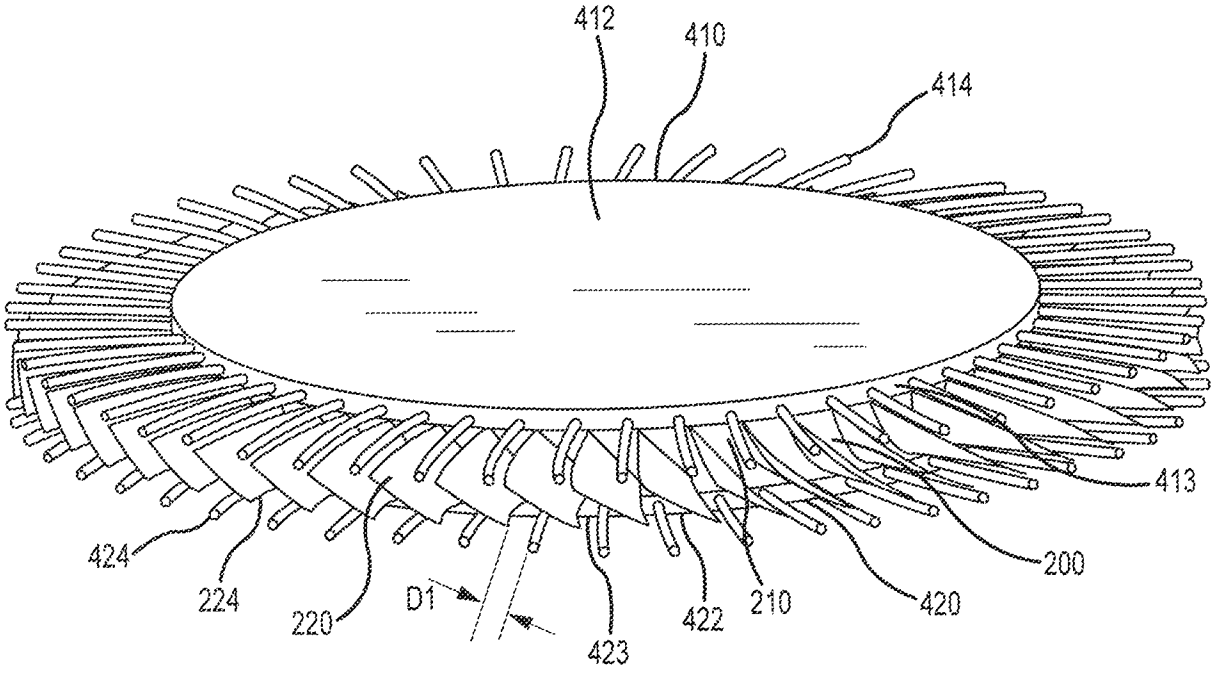
FIG. 4 illustrates a perspective view of an upper shield and a lower shield coupled to a rotor in accordance with various embodiments.

Referring to FIG. 4, a perspective view of an upper shield 410 and a lower shield 420 coupled to rotor 200 is illustrated according to various embodiments. Upper shield 410 may comprise a shield disk 412 and a plurality of spars 414. Shield disk 412 may comprise a substantially cylindrical shape. In various embodiments, shield disk 412 may be sized to mask rotor disk 210 from the abrasive particles. In various embodiments, a diameter of shield disk 412 may be substantially equal to a diameter of rotor disk 210. In various embodiments, shield disk 412 may comprise rapid prototyped SLS nylon. SLS (selective laser sintering) may use a laser to sinter powder based materials in layers to form a solid model. However, in various embodiments, shield disk 412 may be formed using a molded nylon approach, or by any other suitable process.

Figure 6:
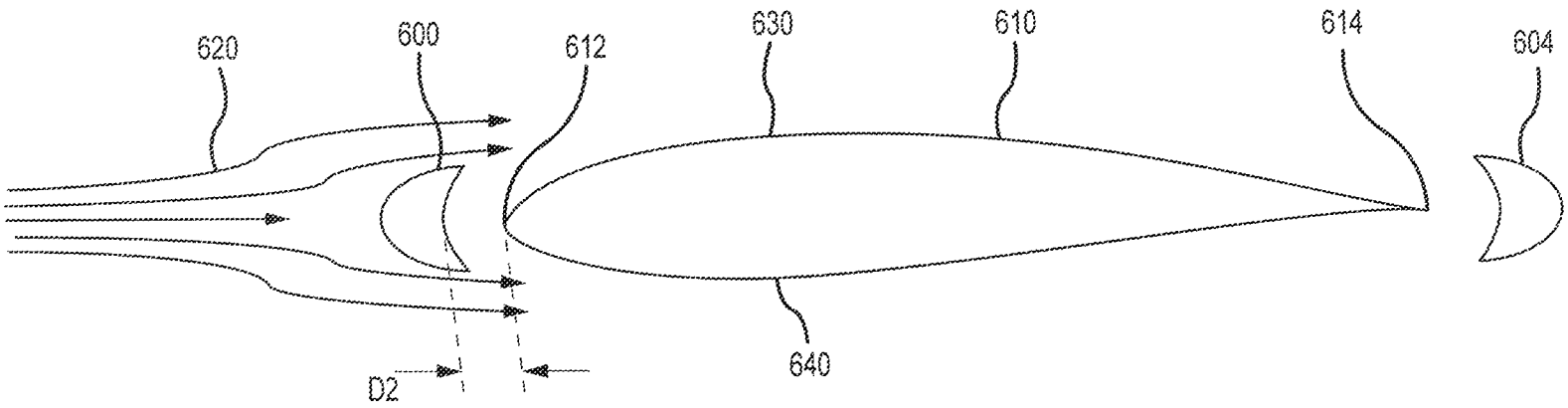
FIG. 6 illustrates a cross-section view of a spar and a blade in accordance with various embodiments.

In various embodiments, upper shield 410 may comprise a plurality of spars 414, wherein each spar 414 corresponds to a blade 220 on rotor 200. For example, in various embodiments an upper shield comprising fifty-three spars may be used in conjunction with a rotor comprising fifty-three blades. However, one skilled in the art will appreciate that upper shields may be manufactured with any number of spars corresponding to rotors with any number of blades. In various embodiments, spars 414 may extend radially outward from a circumference 413 of shield disk 412. In various embodiments, spars 414 may be substantially cylindrical. However, in various embodiments, a cross-section of spars 414 may comprise any shape, such as a crescent as illustrated in FIG. 6. In various embodiments, spars 414 may comprise rapid prototyped SLS nylon.

In various embodiments, spars 414 may be detachably coupled to shield disk 412. In various embodiments, spars 414 may threadingly engage shield disk 412. In various embodiments, spars 414 may comprise a dovetail root which may be inserted into slots in shield disk 412. Thus, in various embodiments, spars 414 may be replaced individually in the event of damage or wear to spars 414.

Similarly, lower shield 420 may comprise a shield disk 422 and a plurality of spars 424. Shield disk 422 may comprise a substantially cylindrical shape. In various embodiments, shield disk 422 may be sized to mask rotor disk 210 from the abrasive particles. In various embodiments, a diameter of shield disk 422 may be substantially equal to a diameter of rotor disk 220. In various embodiments, shield disk 422 may comprise rapid prototyped SLS nylon.

Lower shield 420 may comprise a plurality of spars 424, wherein each spar 424 corresponds to a blade 220 on rotor 200. In various embodiments, spars 424 may extend radially outward from a circumference 423 of shield disk 422. In various embodiments, spars 424 may be substantially cylindrical. However, in various embodiments, a cross-section of spars 424 may comprise any shape, such as a crescent as illustrated in FIG. 6. A profile of spars 424 may correspond to a profile of leading edges 224, such that a distance D1 between spar 424 and corresponding blade 220 is constant at a radius of lower shield 420 and rotor 200. In that regard, the distance D1 between spar 424 and corresponding blade 220 may be constant along the length of spar 424. In other words, spars 424 may be swept or curved to match a shape of leading edges 224. Similarly, a distance between spar 414 and corresponding blade 220 may be constant along the length of spar 414.

Figure 5:
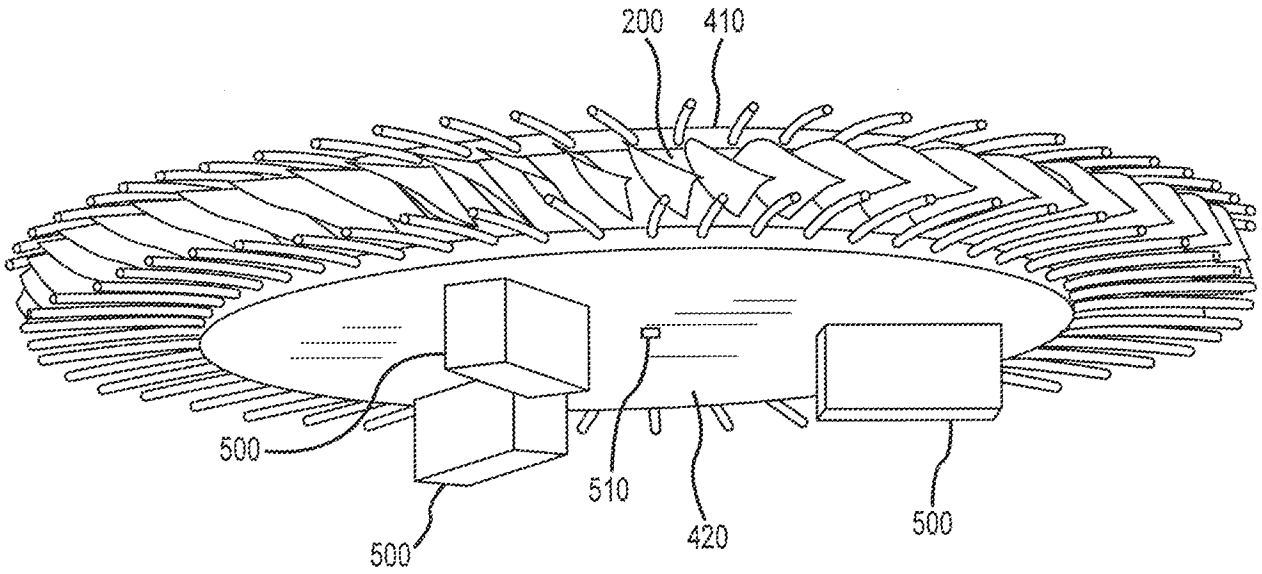
FIG. 5 illustrates a perspective view of a lower shield having platforms in accordance with various embodiments.

Referring to FIG. 5, a perspective view of upper shield 410, rotor 200, and lower shield 420 coupled to platforms 500 is illustrated according to various embodiments. In various embodiments, upper shield 410 may be coupled to lower shield 420. In various embodiments, upper shield 410 may be coupled to lower shield via one or more bolts 510 which extend through bore 230 of rotor 200. In various embodiments, upper shield 410 and lower shield 420 may clamp rotor 200 between upper shield 410 and lower shield 420.

In various embodiments, platforms 500 may be coupled to lower shield 420. In various embodiments, platforms 500 may be integrally formed with lower shield 420. However, in various embodiments, platforms 500 may be separate components from lower shield 420 and may be coupled to lower shield 420 via any fastening device or material. In various embodiments, and referring briefly to FIG. 3, platforms 500 may be configured to be coupled to vibratory bowl 300. Platforms 500 may be bolted to vibratory bowl 300, which may secure lower shield 410, rotor 200, and upper shield 420 in a stationary location relative to vibratory bowl 300. In various embodiments, platforms 500 may be positioned within grooves in vibratory bowl to secure and/or align rotor 200. In various embodiments, at least one of upper shield 420 and lower shield 410 may comprise a bung which may be positioned within bore 230. In various embodiments, bolt 510 may extend through the bung and into vibratory bowl 300, coupling upper shield 420, rotor 200, and lower shield 410 to vibratory bowl 300. Tightening bolt 510 may secure upper shield 420 and lower shield 410 to rotor 200.

Referring to FIG. 6, a cross-section view of a leading spar 600, a trailing spar 604, and a blade 610 is illustrated according to various embodiments. Arrows 620 represent a flow direction of abrasive particles during polishing of blade 610 in a vibratory bowl. Leading spar 600 may shield leading edge 612 of blade 610 from the abrasive particles. Without leading spar 600, leading edge 612 may be subjected to a greater flow than desired of abrasive particles. Such undesirable flow may result in a greater material removal rate at leading edge 612 as compared to other locations on blade 610, which may alter the shape of blade 610. However, leading spar 600 may redirect abrasive particles away from leading edge 612 to upper surface 630 and lower surface 640 of blade 610 and thus decrease undesired material removal at leading edge 612.

In various embodiments, a distance D2 between leading spar 600 and blade 610 may affect the shielding effect of leading spar 600 on leading edge 612. Generally, at greater values for D2, leading spar 600 may have relatively less shielding effect, and at smaller values for D2, leading spar 600 may have a relatively greater shielding effect. In various embodiments, D2 may be selected based on a maximum dimension of the abrasive particles being used to polish blade 610. In various embodiments, D2 may be between 2-3 times the maximum dimension of the abrasive particles, or between 1-10 times the maximum dimension of the abrasive particles. In various embodiments, a cylindrical abrasive particle may have a maximum dimension of 0.5 inches (1.3 cm), and D2 may be between 1.0 inches-1.5 inches (2.5 cm-3.8 cm). In various embodiments, D2 may be greater than the maximum dimension of the abrasive particles, such that the abrasive particles may fit between leading spar 600 and leading edge 612 in order to polish leading edge 612.

In various embodiments, the direction of flow may be reversed, and the abrasive particles may contact trailing spar 604 prior to contacting trailing edge 614. Similarly to leading spar 600, trailing spar 604 may redirect abrasive particles away from trailing edge 614 to upper surface 630 and lower surface 640 of blade 610 and thus decrease undesired material removal at trailing edge 614.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A system comprising:

a first shield comprising a first spar;

a second shield comprising a second spar, wherein the second shield is coupled to the first shield; and a rotor comprising a blade, wherein the rotor is located between the first shield and the second shield.

2. The system of claim 1, further comprising a vibratory bowl coupled to the second shield.

3. The system of claim 1, wherein the first spar and the second spar are configured to direct abrasive particles away from edges of the blade.

4. The system of claim 1, wherein a shape of the first spar corresponds to a trailing edge of the blade, and wherein a shape of the second spar corresponds to a leading edge of the blade.

5. The system of claim 1, wherein a distance between the first spar and the blade is constant along a length of the first spar.

6. The system of claim 1, wherein the first spar is detachably coupled to a shield disk of the first shield.

7. The system of claim 1, wherein the rotor comprises an integrally bladed rotor for a gas turbine engine.

8. A method of polishing a rotor having an airfoil comprising:

coupling a first shield to the rotor, wherein the first shield comprises a first spar;

coupling a second shield to the rotor, wherein the second shield comprises a second spar, wherein the rotor is located between the first shield and the second shield, wherein the first shield is coupled to the second shield; and flowing an abrasive media through the rotor.

9. The method of claim 8, further comprising coupling the second shield to a vibratory bowl.

10. The method of claim 8, further comprising directing the abrasive media away from an edge of the airfoil using at least one of the first spar and the second spar.

11. The method of claim 8, wherein the coupling the first shield to the rotor comprises positioning the first spar such that a distance between the first spar and the airfoil is constant along a radial length of the first spar.

12. The method of claim 8, further comprising detaching the first spar from the first shield and coupling a new spar to the first shield.

* * * * *